United States Patent [19]

Vermillion

[11] 4,172,254

[45] Oct. 23, 1979

[54] MERCHANDISE CASE WITH DOOR LOCK ALARM

[75] Inventor: Eugene F. Vermillion, Columbus, Ohio

[73] Assignee: The Columbus Show Case Company, Columbus, Ohio

[21] Appl. No.: 877,348

[22] Filed: Feb. 13, 1978

[51] Int. Cl.[2] ..... G08B 13/08

[52] U.S. Cl. ..... 340/568; 70/271; 200/61.67; 200/61.93; 340/542; 340/666

[58] Field of Search ..... 340/568, 592, 666; 200/61.67, 61.93; 70/271

[56] References Cited

U.S. PATENT DOCUMENTS

| | | | |
|---|---|---|---|
| 1,658,848 | 2/1928 | Kalikow | 340/666 |
| 2,756,300 | 7/1956 | Thiberville | 340/542 |
| 3,344,629 | 10/1967 | Burney | 340/542 |
| 3,686,660 | 8/1972 | Massover et al. | 340/568 |
| 3,784,776 | 1/1974 | Asanuma | 70/271 |
| 3,892,933 | 7/1975 | Rocchitelli | 200/61.67 |

*Primary Examiner*—Glen R. Swann, III

*Attorney, Agent, or Firm*—William S. Rambo

[57] ABSTRACT

A jewelry show case or similar merchandise container is equipped with a door lock and alarm system which is effective to either automatically lock the access doors of the show case in fully closed positions, or signal an open condition of the doors when an authorized attendant leaves his usual station behind the show case.

3 Claims, 2 Drawing Figures

MERCHANDISE CASE WITH DOOR LOCK ALARM

BACKGROUND OF THE INVENTION

This invention deals generally with door lock alarm systems and more particularly with an improved anti-theft door lock and alarm for a merchandise container, such as a jewelry show case.

U.S. Pat. No. 3,686,660 issued Aug. 22, 1972 to Massover et al, which represents the most pertinent prior art known to applicant, discloses a merchandise show case equipped with an audible alarm system which is activated when an authorized attendant leaves his usual station behind the show case with the access door of the show case in an open position. However, the alarm system of the aforesaid Massover et al patent makes no provision for the automatic locking of the access door of the show case when the attendant leaves his usual station and the deactivation of the alarm system in response to the locking of the show case door.

Accordingly, the present invention may be considered an improvement over the show case alarm system disclosed in the aforesaid Massover et al patent, in that it combines an automatic door lock with the alarm or signal, and provides either for the automatic locking of the door of the show case or the activation of the signal if the attendant should leave his usual station with the door open or slightly ajar.

SUMMARY OF THE INVENTION

According to this invention, a merchandise container, such as a jewelry show case, having an access door, is provided with an electromagnetic operated door lock and a signal which are controlled by a common floor mat, or other personnel proximity-type switch, and which are operable either to automatically lock the door of the show case or signal its unlocked condition if and when the show case is unattended.

The primary object of this invention is to provide an efficient door lock alarm which effectively protects the contents of a show case or similar merchandise container against shop-lifting or theft by stealth.

Further objects and advantages will become more readily apparent by reference to the following description and the accompanying drawing.

DETAILED DESCRIPTION OF PREFERRED EMBODIMENT

Figure 1:
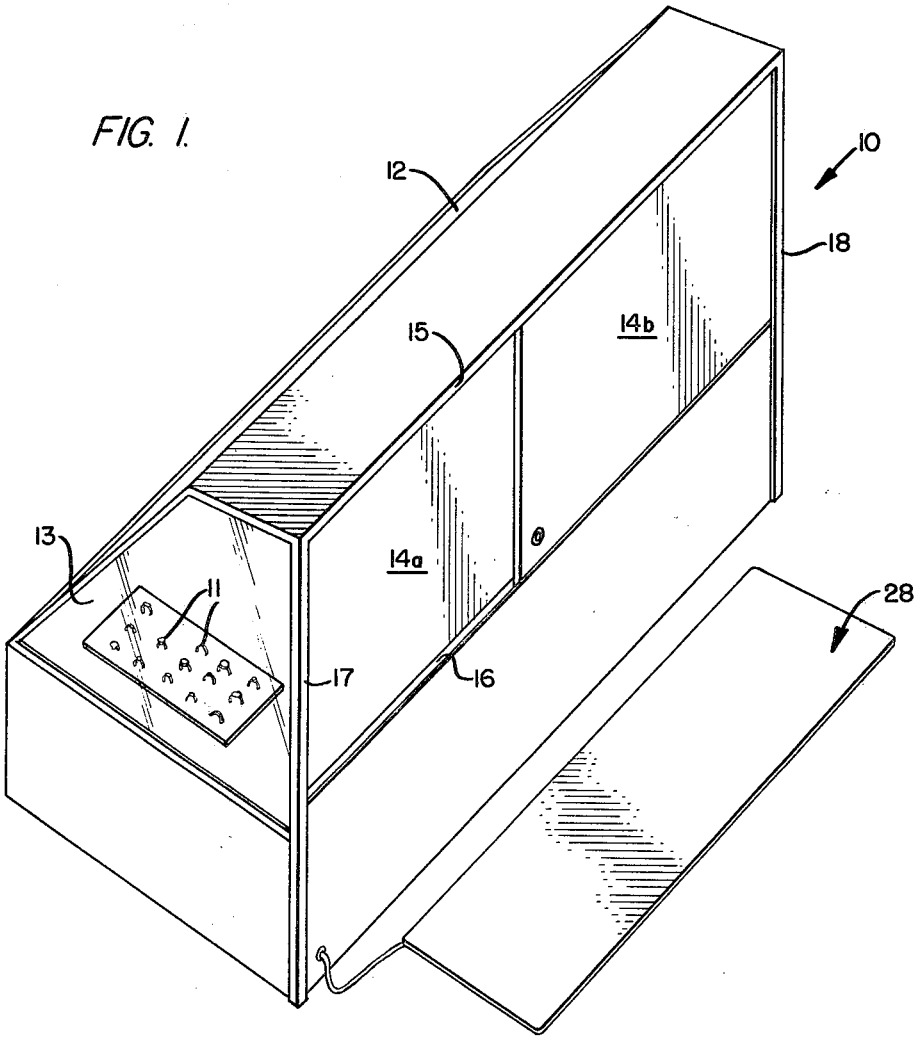
FIG. 1 is a schematic perspective view of a show case equipped with a door lock and alarm according to this invention.

Referring now to the drawings, FIG. 1 depicts a conventional merchandise display container or show case 10 in which the present door lock and alarm system is used. The case 10 may, for example, comprise a jewelry show case in which articles of jewelry 11 may be displayed through the transparent front and side panes 12 and 13, respectively, of the case. The show case 10 also includes a pair of sliding doors 14*a* and 14*b* slidably mounted at the rear of the case in a pair of horizontal channels or guide tracks 15 and 16 which are carried in vertically spaced, parallel relation between the vertical rear corner frame members 17 and 18 of the show case.

The doors 14*a* and 14*b* are slidable between open and closed positions to provide access to the interior of the show case at either side thereof.

Figure 2:
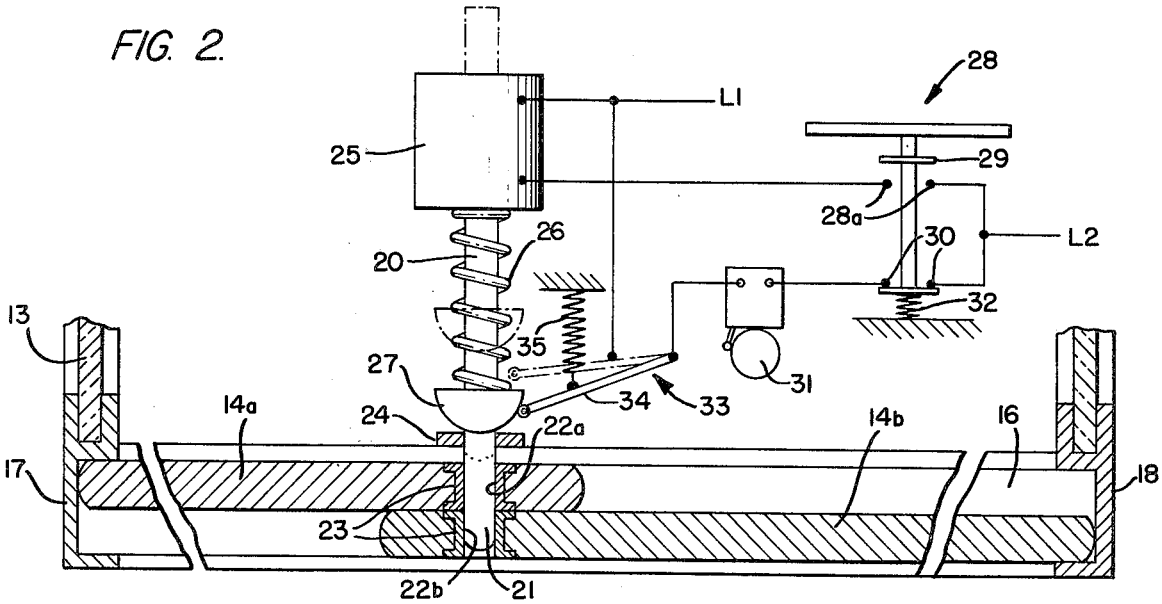
FIG. 2 is an electro-mechanical diagrammatic view illustrating the invention.

In accordance with this invention, the show case 10 is equipped with a door lock and alarm which includes an elongated, movable bolt or latch 20 having a cylindrical outer end portion 21 arranged to enter and engage the walls of catch openings 22*a* and 22*b* formed in the doors 14*a* and 14*b* when the doors occupy their fully closed positions, as shown in FIG. 2. The catch openings 22*a* and 22*b* are preferably defined by a pair of metal grommet-type bushings 23 rigidly secured to the doors adjacent the inner ends thereof. The outer end portion 21 of the latch 20 may advantageously be guided and slidably supported by a bearing strap or bracket 24 welded or otherwise stationarily secured to the frame of the show case inwardly of the doors 14*a* and 14*b*.

The bolt or latch 20 may advantageously comprise, or be attached to, the axially movable armature shaft of an electro-magnetic solenoid 25 mounted within the show case. The solenoid 25 is arranged so that upon energization it will retract the latch 20 and remove the outer end portion 21 thereof from the catch openings 22*a* and 22*b* of the doors 14*a* and 14*b*, as indicated by the dotted lines in FIG. 2. Retracting movement of the latch 20 is yieldably resisted by a return spring 26 positioned between the solenoid 25 and a semi-spherical cam stop 27 which is stationarily secured to the latch 20 inwardly of its outlet end portion 21. The spring 26 is thus arranged to bias or resiliently urge the latch toward its extended door-locking position upon deenergization of the solenoid 25.

With reference to FIG. 2 of the drawing, it will be seen that energization of the solenoid 25 is controlled by a floor mat or other personnel-proximity-type switch generally indicated by reference numeral 28. The switch 28 is preferably positioned on the floor adjacent the rear side of the show case and in a position where a show case attendant normally stands when occupying his usual station behind the show case and in close proximity to the access doors 14*a* and 14*b*. The switch 28 includes a first set of contacts 28*a* which are electrically connected in series with the solenoid 25 between the power supply lines L1 and L2, and which may be closed by a first contactor blade 29. The switch 28 also includes a second set of contacts 30 which are electrically connected between the power supply line L2 and a signal means, preferably an audible alarm bell 31. The switch 28 is normally biased by a spring 32 to a position in which the contacts 30 are closed and the contacts 28*a* are open. However, the weight of a person standing on the switch 28 acts in opposition to the spring 32 to close contacts 28*a* and open contacts 30.

Electrically connected in series between the signal bell 31 and the opposite power supply line L1 is a normally closed limit switch 33 having an actuator arm 34 arranged to be engaged and displaced by the cam stop 27 when the latch 20 occupies its door-locking position. The actuator arm 34 is biased toward a switch closing position by a contractile spring 35.

Operation

In operation, the latch solenoid 25 is energized and the alarm or signal bell 31 is deactivated when the weight of a show case attendant bears on the switch 28. Energization of the solenoid 25 retracts the outer end portion 21 of the latch from the catch openings 22*a* and 22*b* of the doors 14*a* and 14*b*, thus permitting the doors to be freely opened by the attendant. At the same time, retraction of the latch 20 and its cam stop 27 permits the actuator arm 34 to close the switch 33 under action of the spring 35. However, the signal bell 31 will not be energized since the second set of contacts 30 of the switch 28 are open.

If the show case attendant should leave his station behind the show case and atop the floor mat switch 28, the solenoid 25 will be immediately deenergized upon opening of the contacts 28*a* of the floor mat switch. Deenergization of the solenoid permits the spring 26 to snap the latch toward its door locking position. So long as both of the doors 14*a* and 14*b* occupy fully closed positions, the outer end portion 21 of the latch 20 will fully enter and engage the catch openings 22*a* and 22*b* of the doors, thus locking the doors against opening movement. At the same time, the cam stop 27 of the latch will engage and move the actuator arm 34 to open the switch 33, thus interrupting the operating circuit for the signal bell 31. If, however, either of the doors 14*a*, or 14*b* is open or is slightly ajar, the catch opening of such door will be out of alignment with the outer end portion 21 of the latch 20 and as the latch extends upon deenergization of the solenoid, it will strike the face of the open door rather than passing fully into both catch openings 22*a* and 22*b*. This "short-stopping" of the latch leaves the switch 33 in closed condition and the bell 31 is energized to signal the unlocked condition of the show case.

It will thus be apparent that the alarm or signal circuit will be closed only when the show case attendant leaves his usual position on the floor mat switch with one or both doors of the show case open or ajar. So long as the doors of the show case are fully closed, they will be automatically locked by the latch when the attendant steps off the switch 28, thus preventing surreptitious opening of the doors by a person reaching over the top or around an end of the show case when it is unattended. As will be readily understood, the alarm or signal bell is intended primarily to remind or warn the show case attendant that he has left his usual protective station behind the show case with a door open and unlocked. All the attendant needs to do, if he hears the alarm or signal, is slide the door or doors to their fully closed position, so that the latch may then lock the doors and deactivate the alarm or signal bell.

While a single exemplary embodiment of the invention has been illustrated and described in detail, it will be understood that various modifications in design and details of construction are possible without departing from the spirit of the invention or the scope of the following claims.

I claim:

1. In combination with a merchandise container having an access door movable between container opening and closing positions; a movable door latch positioned within the confines of said container and biased toward a door-engaging position which provides a locking engagement with said door only when said door occupies a fully closed position allowing said latch to be fully extended, said door otherwise blocking extension of said latch; electromagnetic means connected with said latch and energizable to move said latch to a door-disengaging position; manually operable switch means disposed exteriorly of but in close proximity to said container for controlling energization of said electromagnetic means; and signal means electrically connected with said switch means and responsive to the position of said latch and said switch means for signalling an open condition of said door only when said electromagnetic means is deenergized and said latch is not fully extended.

2. The combination defined in claim 1, wherein said signal means comprises an audible alarm.

3. The combination defined in claim 1, wherein said container comprises a jewelry show case and said switch means is contained in a floor mat disposed in an area normally occupied by a show case attendant.

* * * * *